United States Patent [19]

Garro

[11] 4,341,099

[45] Jul. 27, 1982

[54] CODE CHANGING SYSTEM FOR COMBINATION PADLOCKS

[75] Inventor: Jose P. Garro, Irun, Spain

[73] Assignee: Talleres de Escoriaza S.A., Irun, Spain

[21] Appl. No.: 164,080

[22] Filed: Jun. 30, 1980

[30] Foreign Application Priority Data

Jul. 2, 1979 [ES] Spain ..... 482.109

[51] Int. Cl.[3] ..... E05B 37/00; E05B 37/06

[52] U.S. Cl. ..... 70/25; 70/316

[58] Field of Search ..... 70/25, 315, 316, 317, 70/318

[56] References Cited

U.S. PATENT DOCUMENTS 3,720,082 3/1973 Feinberg ..... 70/25

3,766,758 10/1973 Heine ..... 70/25

4,048,821 9/1977 Bako ..... 70/25

*Primary Examiner*—Robert L. Wolfe

*Attorney, Agent, or Firm*—Robert E. Ross

[57] ABSTRACT

A code changing mechanism for padlocks of the type comprising code wheels and lock operating bushings releasably connected to the code wheels in which axial movement of the shaft disengages the bushings from the code wheels to permit changing of the code, and in which the long leg of the shackle has means for engaging the end of the shaft to move it axially to the disengaging position when the shackle is depressed into the body in an orientation other than the locking orientation. In one embodiment of the invention the shackle can be locked in the open position to prevent code changing without knowledge of the existing code.

5 Claims, 13 Drawing Figures

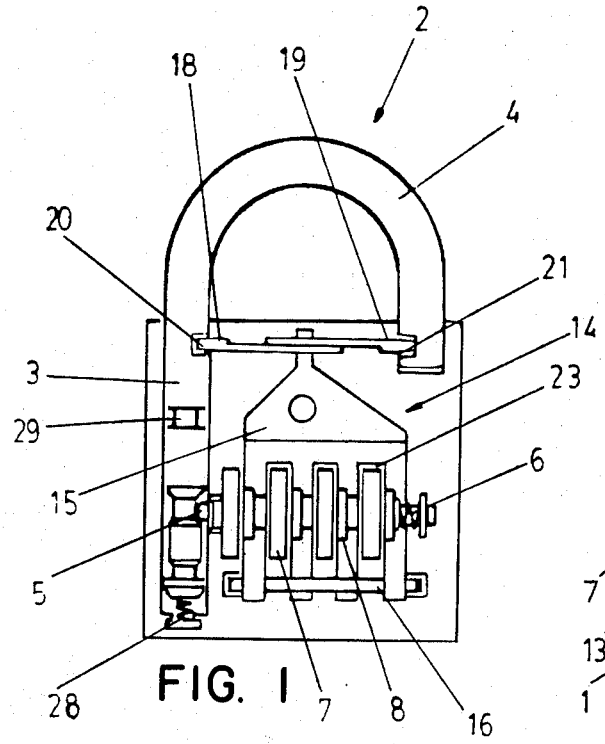
FIG. 1
FIG. 2
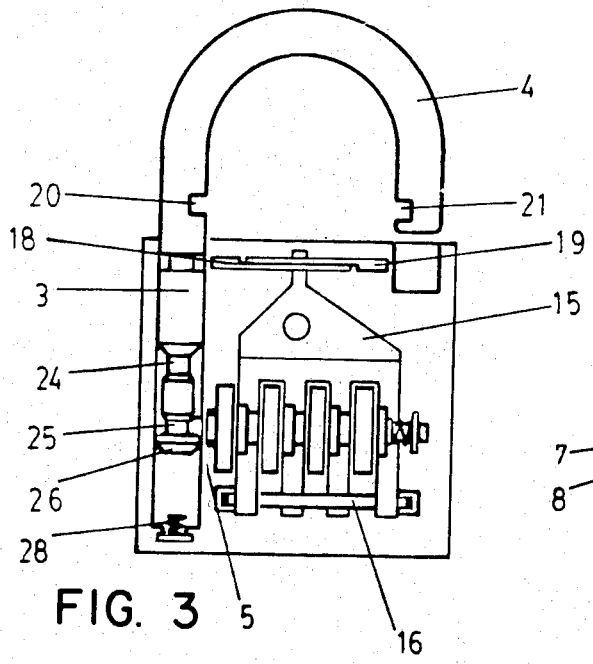
FIG. 3
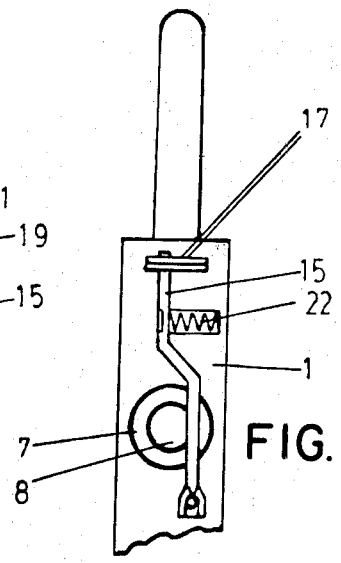
FIG. 4

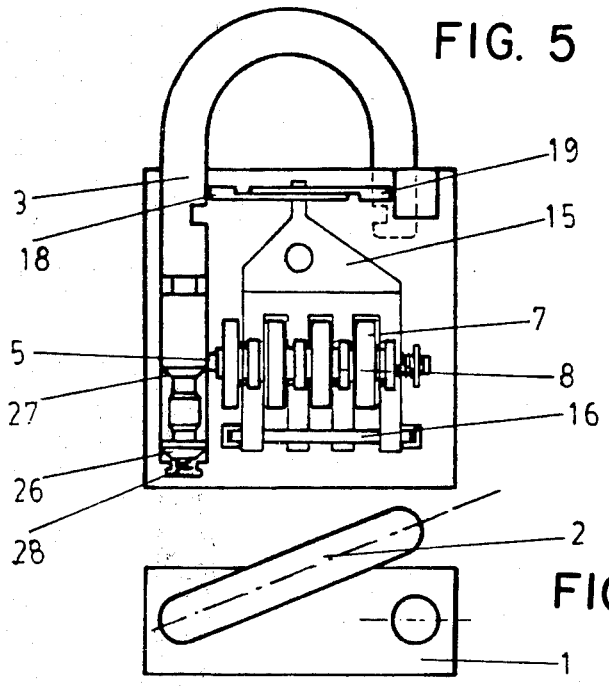
FIG. 5
FIG. 6
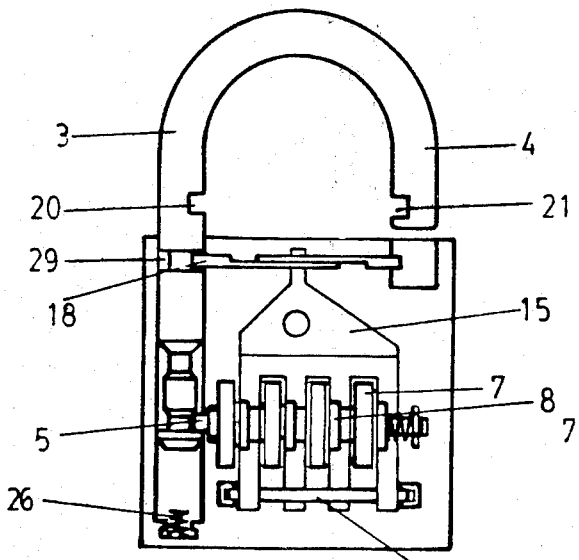
FIG. 7
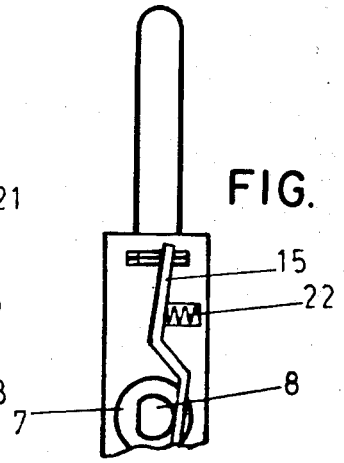
FIG. 8

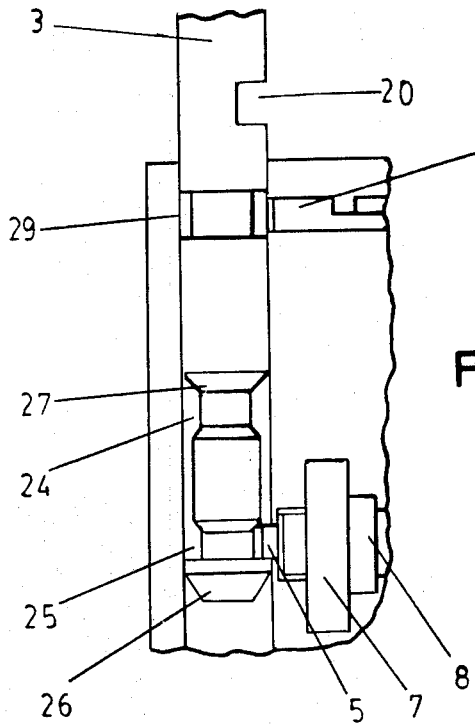
FIG. 11
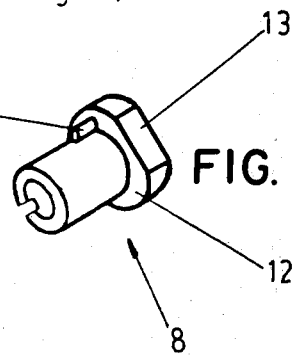
FIG. 10
FIG. 9
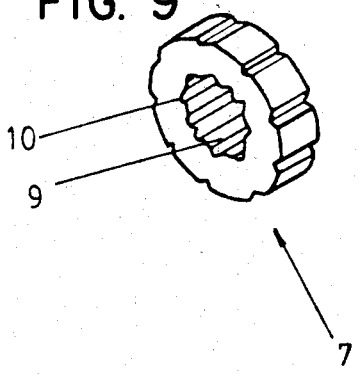

CODE CHANGING SYSTEM FOR COMBINATION PADLOCKS

The invention refers to some improvements introduced in combination padlocks and more in particular on the code changing system.

Said padlocks basically have a general body with a combination mechanism formed by a shaft upon which there are mounted some digit wheels and the pertinent bushings clutched with same and which have a flattened surface, which (the bushings) have contact with a closing latch which actuates upon the padlock's ring in order to set same in locking position.

Different systems have been provided on these padlocks which will enable a modification of the code to be carried out which must be established for carrying out the pertinent aperture of same.

The invention refers to a series of improvements in the code changing system which can only be carried out with the ring being in the opened position and the established combination.

In accordance with said improvements there has been placed in front at the end of the long end of the ring a spring against which the ring must be constantly maintained in a displacement position for provoking, through a frustrum conical part provided in the long part of the ring, the displacement of the shaft of the code mechanism and the de-clutching of the bushings in relation to the wheels, in order to be able to carry out the combination, pushing position which can be occupied in an angular position of the ring different to the locking one and always when the code mechanism is in the open position.

As per a particularity of the invention, the ring also has, apart from the grooves on the long and the short part, a second groove on the long part between the first groove and its free end, upon which the locking means actuate with the code mechanism being in the closing position and the ring extracted in such a way that it will make it impossible to displace the ring inwards for locking the padlock whilst the mechanism is not in the open position, avoiding any possibility of code change without knowing same.

As per the particularity of the invention, the long part of the ring presents between the conical frustrum which originates the displacement of the shaft in the push position of same and the free end of the ring, two recesses which are provided for the housing of the end of the shaft in order to define two stable positions of the ring, one extracted and the other lowered, without needing additional elements and making use of the spring of the combination itself.

FIGS. 1 and 2 correspond to top and side views of the combination padlock with the improvements which are the object of the invention in the closed position. On FIG. 1 the inside of the padlock can be seen.

FIGS. 3 and 4 pertain to the open position of the padlock.

FIGS. 5 and 6 pertain to the position of the padlock in which the code change can be carried out.

FIGS. 7 and 8 pertain to the position of the padlock with the ring extracted and the code mechanism in the closed position for camouflaging the combination.

FIGS. 9 and 10 pertain to perspective views of the wheels and bushing which are constituting part of the code mechanism.

FIG. 11 shows in detail the long part of the ring in relation to the closing mechanism.

Figure 12:
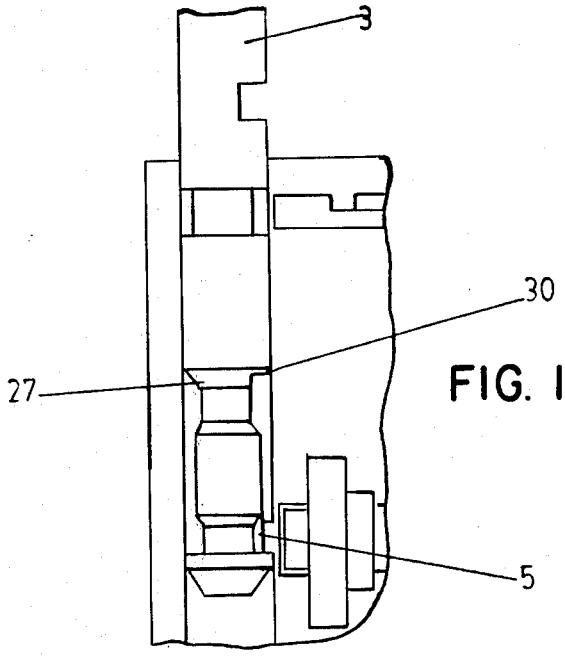
FIG. 12 shows a detail of the shape of the ring in order to avoid the involuntary change of the code with the ring being in the extracted position but in the angular closing position, with the established code.

The combination padlock is basically formed by a general body (1) with a ring (2) which presents a long part (3) and a short part (4), housing within said body a shaft (5) which is displaceable against the spring (6) and upon which the digit holding wheels (7) are mounted and some bushings (8) clutched with same.

Just as they appear in FIGS. 9 and 10, the wheels (7) have on their periphery a series of figures for establishing an opening combination and in an axial orifice (9) a series of arched gaps (10) in the form of teeth, in as many combination digits the wheel may have on its periphery (7). Each bushing clutches onto the pertinent wheel through some protuberances (11) which gear in the gaps (10) of the wheels (7). Also each bushing (8) has an edging (12) which is provided with a flattened area (13).

The edgings (12) of the bushings (8) get in contact with a closing latch (14), which in a case of non-limitative construction provides a piece (15) which can basculate in relation to a shaft (16) which is laid out on its lower end whilst its upper end actuates upon the grooves (17) which are provided on two arms (18) and (19) which are diametrically opposed whose ends permit the locking or the unlocking of the ring in its closing position upon inserting itself in the pertinent grooves (20) and (21) of the long part (3) and short part (4) of the ring (2).

Close to the upper end, the basculating piece lays upon the spring (22) against which it rotates. Said piece (15) of the closing latch (14) has a series of openings (23) through which the digit wheels go through (7) which partially come outside the body (1).

On FIGS. 1 to 8 a specific closing latch has been represented but another closing system can also be used through two or one basculating and locking piece.

When the wheels (7) are in the correct code position, the flattened area (13) of the bushings (8) are aligned and then the piece (15) of the locking latch (14) basculates by the action of the spring (22) displacing arms (18) and (19) towards the inside and with its ends coming from grooves (20) and (21) of the ring thus being able to move same outwards, as is shown on FIGS. 3 and 4 which pertain to its opened position.

The long part of the ring (2) is placed in front of the end of the shaft (5) and has a series of recessed areas (24) and (25) which permit the ring to take up two stable positions, one lower one in which the long part (3) is inserted within the body (1) and the other in which it is taken out until the widening (26) of the end hits against the end of the shaft (5).

Stability in both positions is obtained upon housing the end of the shaft (5) in said recesses, maintaining the ring in the pertinent position without the addition of supplementary elements, but by the action of the spring (6) itself of the code mechanism which pushes the shaft (5) towards the ring recesses.

In accordance with the figures of the long part (3) of the ring (2) it has a conical frustrum part (27) which upon being opposed to the end of the shaft (5) determines the axial displacement of same against the spring (6). Said displacement determines the de-clutching of the bushings (8) in relation to their pertinent wheels (7) against the spring (6) in such a way that in this position the angular relative position between bushings (8) and wheels (7) can be modified in order to modify the code or opening combination of the padlock.

The displacement of the ring (2) for carrying the modification of the code, is carried out against the spring's action (28) which resting upon a recess of the body (1) places itself in front of end (26) of the long part (3) of the ring (2).

The displacement of the ring against the spring (28) is always carried out when the combination has been established and with the ring extracted at any angular position of same different to that of closing. In this closing position means have been provided which even with the combination open impede the displacement of the ring (2) inwards, in order to avoid an involuntary change of the code by thinking that what is being done is locking the padlock. These means can be located, for example, in the short part (4) or long part (3) of the ring.

On FIG. 12 a form of execution of these means has been represented, consisting in the fact that the conical frustrum part (27) which has a step (30) which upon trying to lower the ring in the closing angular position, hits against the end of the shaft (5).

Figure 13:
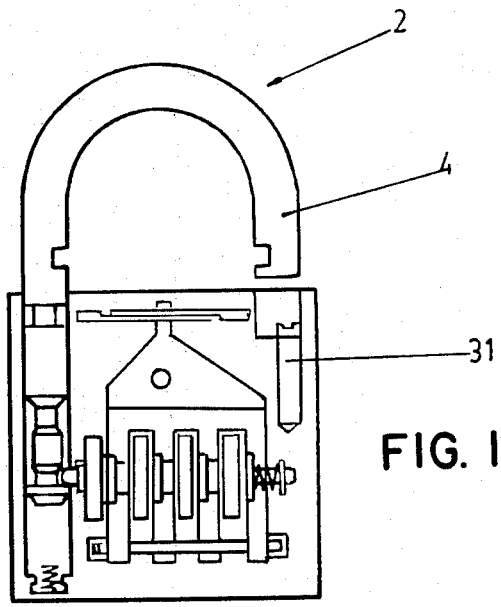
FIG. 13 shows in a detailed manner another way of execution other than that foreseen in FIG. 12.

Another form of execution is represented on FIG. 13. In this case it is the short part (4) which hits against a step of the body (1) or against a screw (31) which is provided on the body (1).

In any case, in order to modify the combination one always has to be pressing the ring (2) against the spring (28), as is shown on FIGS. 5 and 6 and after having previously placed the wheels (7) in the combination position which we wish to modify for a new one.

In accordance with a characteristic of the invention, on the long part (3) of the ring (2) a second groove (29) has been provided between the first (20) and the free end (26) which in the position in which this end (26) butts against the end of the shaft (5) this is, in the position in which the ring (2) is extracted it remains in front of the locking mechanism of the ring (2). In this case the groove (29) remains in front of the arm (18). With the ring being out (2) one or several digit holder wheels can be displaced (7) of the locking mechanism for the purpose of camouflaging the combination which determines the displacement of the closing latch (14) and the locking of the ring (2) in its extracted position. In this way it is avoided that, with the ring being in the extracted position, nobody can manipulate the padlock if previously the code mechanism in open combination has not been placed thus making it impossible for anybody who doesn't know the code to be able to close the padlock or modify the combination.

I claim:

1. In a combination padlock of the type having a body, a code mechanism comprising an axially movable shaft having digit display wheels mounted thereon and bushings spring biased into engagement with the wheels, said bushings each having a generally circular periphery with a flattened portion, a locking element movable between an unlocking and a locking position by said bushings, and a shackle having a long leg retained in the body and a short leg for entering a body aperture when the shackle is oriented to the locking position and closed, the improvement comprising means on said long leg for engaging the end of the shaft and causing it to move axially when the shackle is oriented to a position other than the locking position and pressed into the body, said axial movement of the shaft causing said bushings to become released from the wheels to allow the code to be changed.

2. A combination padlock as set out in claim 1 in which said means on the long leg comprises a portion which is frusto-conical in an orientation thereon other than directly opposite the short leg, and stop means is provided on said long leg at an orientation directly opposite the short leg positioned to engage the end of the shaft when the shackle is oriented in the locking position so that when the shackle is in said orientation, downward pressure on the shackle does not cause axial movement of the shaft.

3. A combination padlock as set out in claim 1 in which said shaft is biased axially toward the long leg of the shackle and said shackle has two spaced recesses into which the end of the shaft seats when said recesses are opposite said shaft, the lower of said recesses being positioned to maintain the shackle in the unlocked position, and the upper of said recesses being positioned to maintain the shackle in the locked position.

4. A combination padlock as set out in claim 3 in which said frusto-conical portion is disposed at the upper end of said upper recess, whereby depression of the shackle to a position below the normal locking position is required to cause the axial movement of the shaft to release the bushings from the wheels.

5. A combination padlock as set out in claim 1 in which the long leg of the shackle has a first locking recess to receive locking means controlled by the code mechanism when the shackle is in the locking position, and a second locking recess positioned to receive the locking means when the shackle is in the open position, whereby the shackle can be locked in the open position so that the shackle cannot thereafter be depressed to the code changing position without unlocking the locking means.

* * * * *